US007454810B2

(12) United States Patent
Wells

(10) Patent No.: US 7,454,810 B2
(45) Date of Patent: Nov. 25, 2008

(54) DIVIDED SUPPORT MATTRESS

(76) Inventor: Thomas J. Wells, 801 Country Club Rd., Carthage, MO (US) 64836

( * ) Notice: Subject to any disclaimer, the term of this patent is extended or adjusted under 35 U.S.C. 154(b) by 166 days.

(21) Appl. No.: 11/425,169

(22) Filed: Jun. 20, 2006

(65) Prior Publication Data

US 2007/0289069 A1 Dec. 20, 2007

(51) Int. Cl.
*A47C 27/15* (2006.01)

(52) U.S. Cl. ..... 5/727; 5/722; 5/737

(58) Field of Classification Search ..... 5/691, 5/722, 727–728, 737–738
See application file for complete search history.

(56) References Cited

U.S. PATENT DOCUMENTS 2,651,788 A 9/1953 Forwood
3,308,492 A * 3/1967 Lovette ..... 5/722
4,231,127 A * 11/1980 Bendell ..... 5/722
4,449,261 A 5/1984 Magnusson
5,513,402 A 5/1996 Schwartz
6,101,653 A 8/2000 England
6,269,504 B1 8/2001 Romano et al.
6,957,465 B1 10/2005 Oprandi
2003/0135930 A1 7/2003 Varese et al.
2004/0255387 A1 12/2004 England

* cited by examiner

*Primary Examiner*—Fredrick Conley
(74) *Attorney, Agent, or Firm*—Wood, Herron & Evans, LLP

(57) ABSTRACT

A divided mattress is disclosed having multiple sections separated by an expansible divider such that movement atop one section of the mattress is isolated and not felt from the adjacent section.

11 Claims, 4 Drawing Sheets

DIVIDED SUPPORT MATTRESS

FIELD OF THE INVENTION

This invention relates to bedding mattresses and, more particularly, to a mattress having a divided top portion separated by an expansible divider such that weight distribution or movement atop one portion of the mattress will not be imparted to the other portion of the mattress. In one embodiment, the mattress is divided into two halves, such that movement by one person on one half of the mattress will be absorbed by the expansible divider and not imparted to the other half of the mattress.

BACKGROUND OF THE INVENTION

The prior art is replete with disclosures of mattresses which have varying degrees of firmness for separate halves of the mattress and even varying degrees of firmness throughout each half, such that a person resting on one half of the mattress will be supported by a mattress having one degree of firmness, either throughout that half or varying throughout that half, and another person sleeping on the other half may have the same or a differing degree of firmness supporting that other person. Additionally, the prior art is replete with mattresses which even allow changes or adjustment of the firmness within each half of the mattress as, for example, by opening all or each half of the mattress to replace the supporting elements within that half. For example, such disclosures are contained in Forwood U.S. Pat. No. 2,651,788; Magnusson U.S. Pat. No. 4,449,261; and, England U.S. Pat. No. 6,101,653. According to the disclosure of these patents, the mattress core elements are intended to be removable and/or interchangeable and, to this end, the mattress cover is provided on the sides with a zipper or other closure to facilitate ease of opening the cover so as to make the change in the core elements.

But the changeability or interchangeability of the mattress core elements does not eliminate the problem of weight distribution or movement atop one portion of the mattress influencing movement of another portion of the mattress. Consequently, if a person on one half of the mattress rolls over, the person on the other half of the mattress feels that movement through the connected halves or sections of the mattress. Or if a heavy portion of body rests atop one portion of the mattress, it causes the adjacent portion of the mattress to be depressed.

It has therefore been an objective of this invention to isolate movement on one half or one section of a mattress from that movement being felt or causing depression or movement in the other adjacent half or section of the mattress.

Still another objective of this invention has been to create a mattress which is both economically and commercially feasible, but which is so constructed so as to prevent movement of one portion or one person on one section of a mattress from being imparted to or felt by a person on another section of the mattress.

Still another objective of this invention has been to provide a changeable firmness divided mattress in which movement of a person on one section of the mattress is sufficiently isolated from another section of the mattress that a person resting on that other section will not feel movement on that one section.

SUMMARY OF THE INVENTION

These and other objects and advantages of this invention are provided by a divided or split support mattress having a common lower core support member or portion and an upper topper or comfort portion resting atop that lower core support member, which upper topper portion has an expansible divider separating the upper topper portion into two sections or halves, such that movement atop one of those sections or halves will be absorbed by the expansible divider and not imparted to the other of the two halves. In one embodiment of the invention, the expansible divider comprises a fold in at least a top fabric cover of the upper topper portion of the mattress, which fold isolates and separates the two sections or halves of the upper topper portion of the mattress. That fold may, and preferably is, fixedly secured to the top of the lower core mattress support member or section.

In the practice of one embodiment of this invention, the upper topper portion of the mattress includes a closure mechanism or zipper selectively permitting access to the interior of the upper topper portion of the mattress which is divided along its length by the expandible divider. In accordance with the practice of this invention, the divided upper topper portion has a plurality of support elements which may be selectively provided and inserted into the interior of the upper topper portion so as to enable the firmness of the two halves of the mattress to be altered or varied as between the two halves and over the length of the individual halves.

In one preferred embodiment of this invention, the expansible divider is formed solely by a fold in the top fabric of the mattress. Consequently, the presence of the expansible divider is not unsightly and cannot be felt by a person rolling on the mattress and across the divider.

BRIEF DESCRIPTION OF THE DRAWINGS

Other objects and advantages of this invention will be more fully appreciated from the following description of the drawings, in which.

Figure 1:
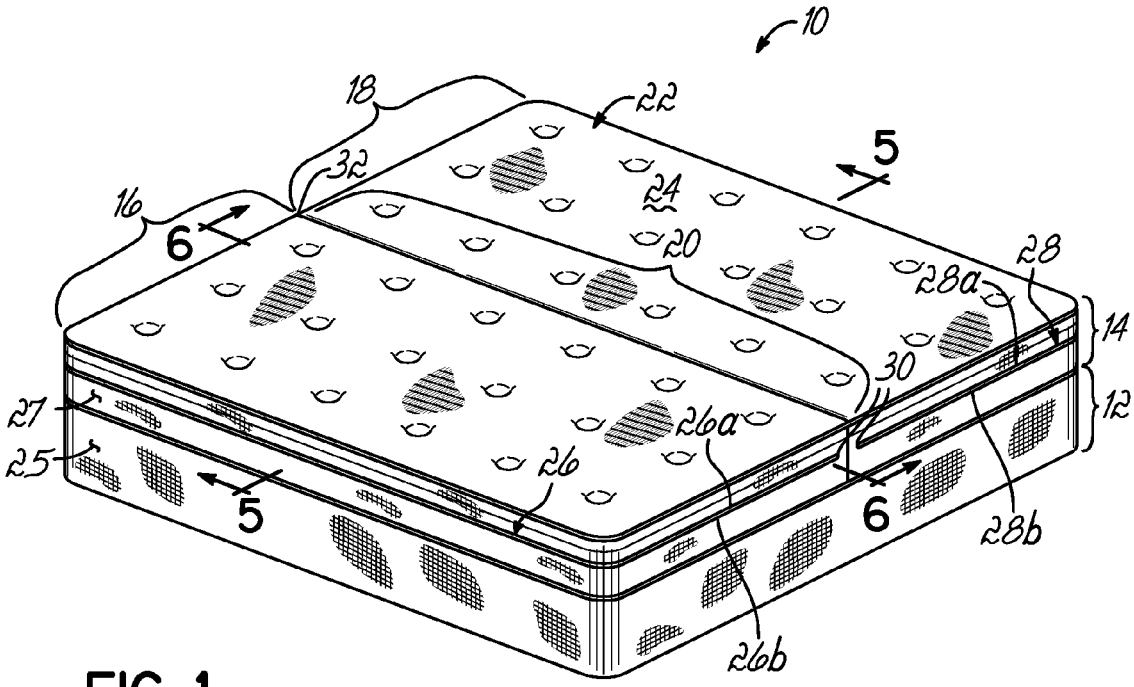
FIG. 1 is a perspective view of one embodiment of a mattress incorporating the invention of this application.
Figure 2:
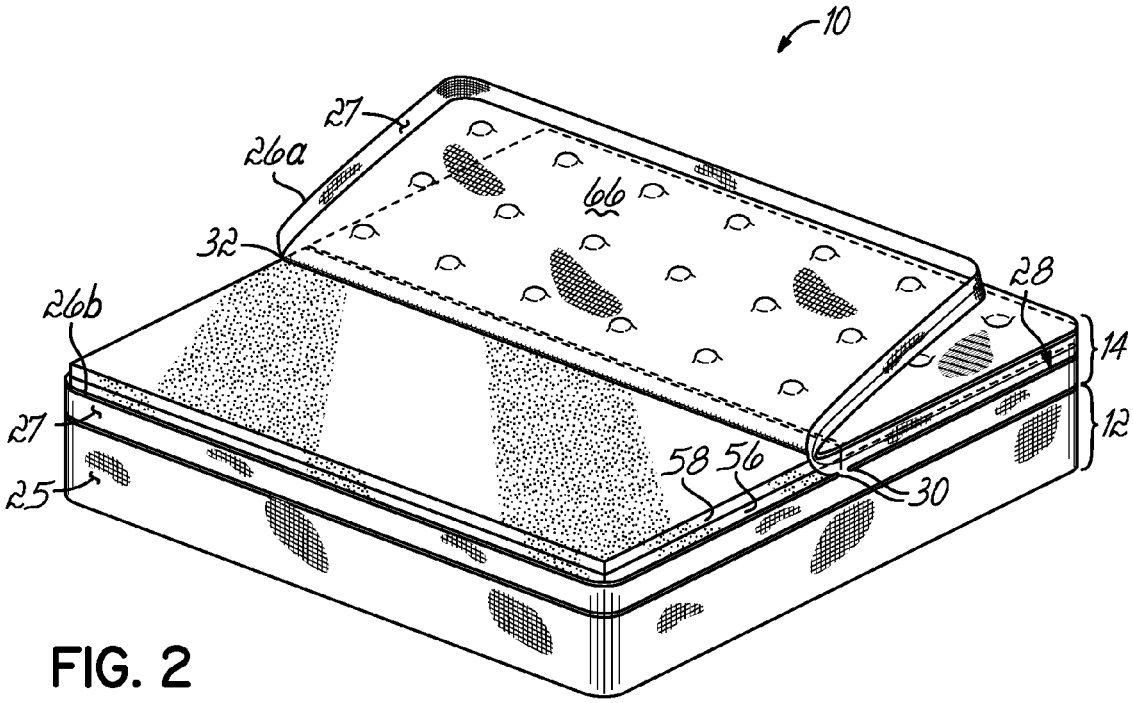
FIG. 2 is a view similar to FIG. 1 but with the upholstered top covering of the mattress folded so as to expose the underlying comfort portion of the mattress.
Figure 3:
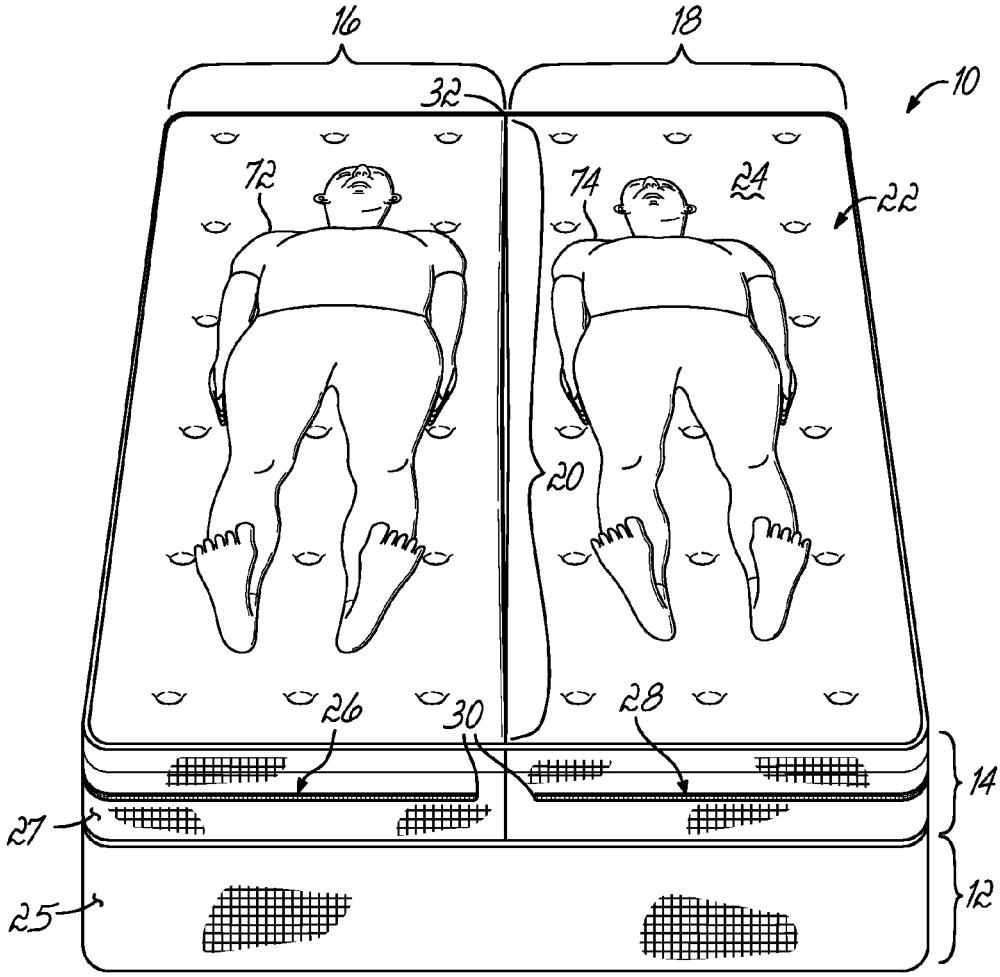
FIG. 3 is a perspective view of the mattress of FIG. 1 showing how two persons residing on the mattress may have their movements isolated one from the other by an expansible divider of the mattress.

With reference first to FIGS. 1 and 2, it will be seen that there is illustrated a mattress 10 having a lower core support portion 12 and an upper topper or comfort portion 14. The upper comfort portion 14 is split or divided longitudinally into two sections 16, 18 separated by an expandible divider 20. Each section 16, 18 is intended to support an individual person, as illustrated in FIG. 3 in such a manner that movement of a person on one section is not imparted to the other person. The complete mattress, including the lower core support portion 12 and the upper comfort portion, or so-called topper portion 14, is enclosed within a fabric cover 22. This fabric cover 22 may be quilted on the top surface 24 and even the side panels 25, 27 although the side panels are not so illustrated in FIG. 1.

In the preferred embodiment of the invention here illustrated and described, the topper or comfort portion 14 of the mattress 10 is provided about the periphery thereof with a closure device, preferably a pair of zippers 26, 28 which facilitates access to the interior of each section 16 and 18 of the mattress. Thereby, comfort materials contained within each section 16, 18 may be altered to vary the firmness or feel of each individual section. To that end, preferably each zipper 26, 28 extends from a point 30 adjacent the division between the two sections at one end of the mattress to a point 32 adjacent the division between the two sections at the other end of the mattress. Thereby, each section may be individually accessed and multiple plies of comfort materials (the foam or fiber layers 56, 58) contained therein removed and replaced by other plies of comfort materials such as short springs, foam and fiber layers of differing firmness and resiliency characteristics. While the closure mechanism is preferably a pair of zippers, the closure device may comprise only a single zipper or may be comprised of other conventional types of closure devices, such as Velcro® hook and loop closures, snap fasteners, etc.

The lower core support portion 12 of the mattress comprises a conventional matrix of springs 38 (see FIGS. 5, 6, 7) arranged in rows and columns and connected by helical lacing wires 40 as is now conventional in innerspring mattresses. Alternatively, the core support portion 12 may comprise in lieu of springs resilient urethane or latex foam, or combinations of springs and foam. In the illustrated embodiment (see FIG. 5), the matrix of springs 38 is supported atop an insulator pad 42. Similarly, an insulator pad 42 rests atop the springs so as to prevent those springs from cutting into the materials contained in the topper or comfort portion 14 of the mattress. Additionally, the core portion of the mattress includes a fabric covering material 46 located beneath the lower insulating pad 42 and an upper ply of covering material 48 resting atop the upper insulator pad 42. Generally, the plies of covering materials 46 and 48 will be non-woven fabric materials. But they could, as well, be woven fabric materials or even non-woven plastic materials.

Figure 5:
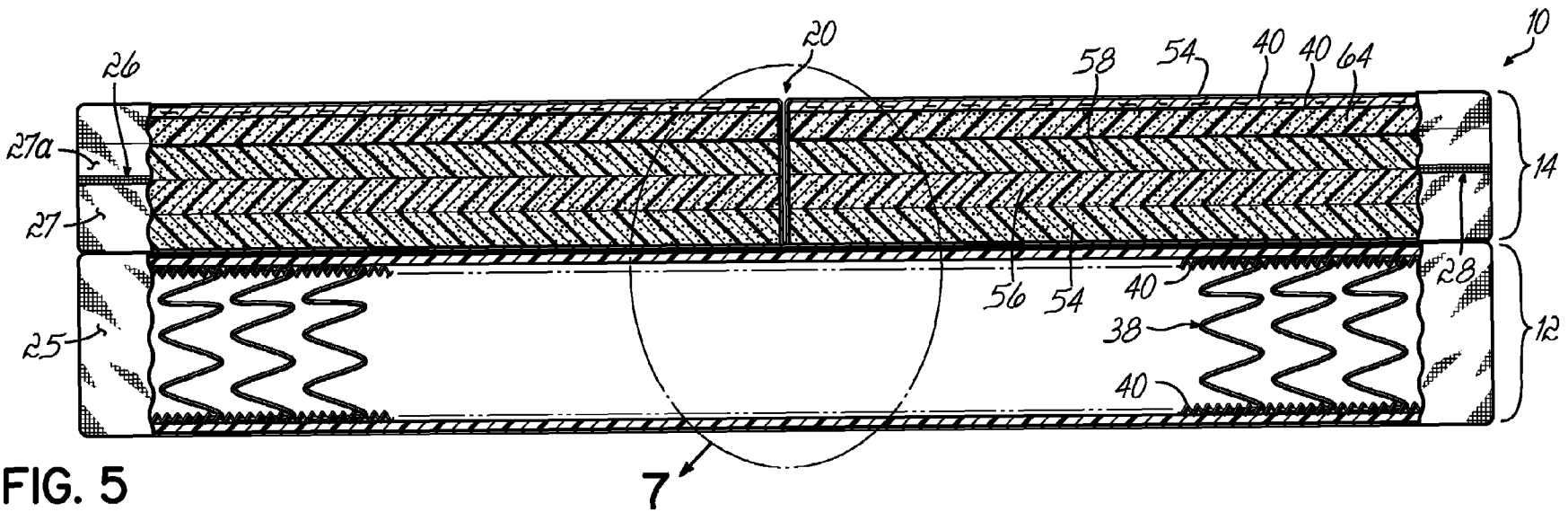
FIG. 5 is a cross sectional view of the mattress taken generally on line 5-5 of FIG.1.
Figure 6:
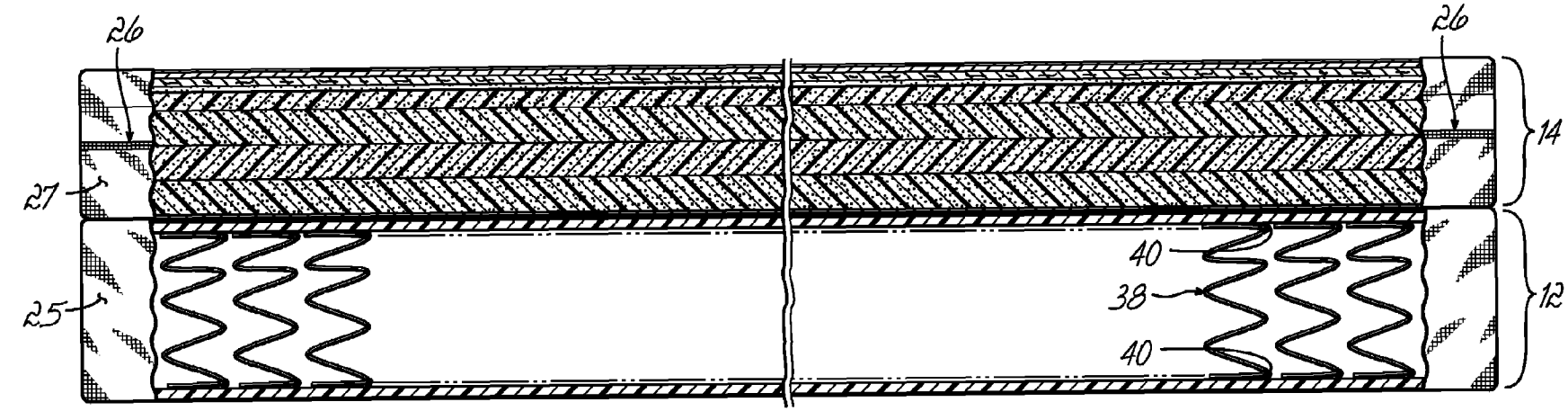
FIG. 6 is a cross sectional view taken generally on line 6-6 of FIG. 1.
Figure 7:
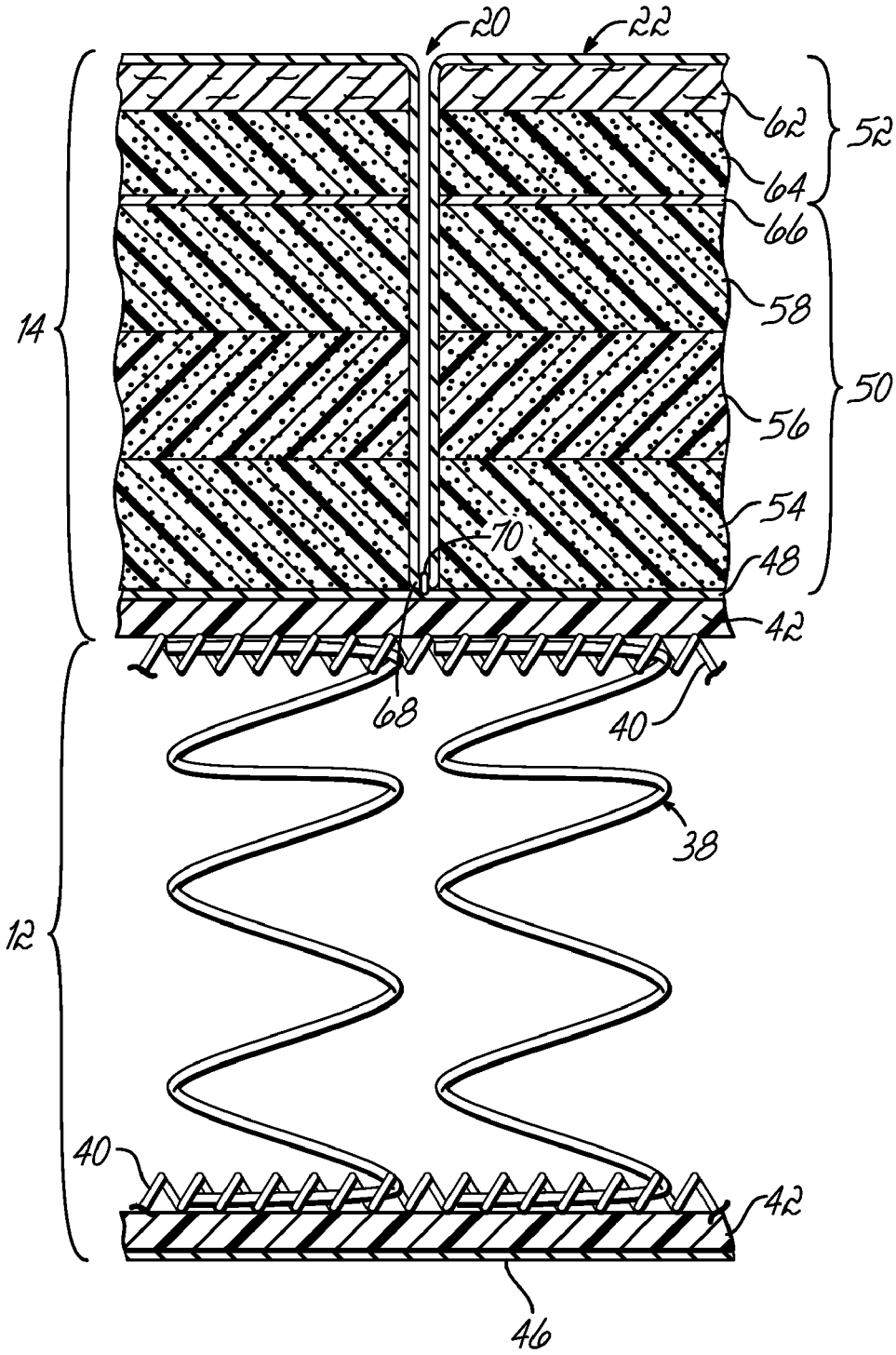
FIG. 7 is an enlarged perspective view of the encircled center portion 7 of FIG. 5.

With reference now to FIGS. 5, 6 and 7, it will be seen that the upper topper or comfort portion 14 of the mattress comprises a lower comfort panel 50 and an upper quilt panel 52. The cover portion of the comfort panel 50 is illustrated in the preferred embodiment as containing three distinct plies or layers of foam material 54, 56, 58. It could as well, though, comprise only a single layer of foam material or multiple layers or plies of combination foam, short springs and fiber material. These layers of comfort materials 54, 56, 58 may be removed and replaced by layers of plies of differing firmness materials by simply opening the zipper or closure devices 26 or 28 on one side of the mattress and replacing those materials on that side or section 16, 18.

The upper quilt panel 52 of the preferred embodiment comprises a top ply 22 of upholstered style fabric material, which is generally a woven material, an underlying ply of fiber material 62, a ply of foam material 64, and an underlying ply of fabric material 66. The upper quilt panels 52, though, could as well comprise all fiber rather than fiber and foam combination or any other combination of soft resilient materials. Additionally, the underlying ply 66 of fabric material may be either woven or unwoven fabric material or could even by a ply of plastic material, although fabric is generally preferable.

With reference now to FIG. 5, it will be seen that the expandible divider 20, which extends for the full length of the mattress, comprises a fold in the top fabric covering material 22 which extends for the full depth of the topper or comfort portion 14 of the mattress. In one embodiment of the invention, the comfort portion 14 of the mattress was 3 inches in height and the quilt panel was 1½ inches in height. Consequently, the fold of covering material 22 defined between the two sections 16 and 18 of the mattress extended for a depth of 4½ inches. At the bottom 68 of the fold 20 of top covering material 22, the bottom 68 of the fold 20 is sewn by a seam 70 to the fabric covering material 48 of the core support portion 12 of the mattress. Rather than being sewn at the bottom of the fold to the top of the core portion of the mattress, the bottom 68 of the fold may be welded if the fabric materials contain thermoplastic fibers or may even be adhered or connected by any other conventional fabric connecting mechanism.

As a consequence of the fold 20 being fixedly secured at the bottom 68 of the fold or expansible divider 20 to the top of the core support portion 12 of the mattress, the total comfort portion 14 is secured against lateral movement relative to the core support portion 12 of the mattress 10 and one side 16 of the mattress is isolated from the other 18 by the expandible fold 20.

The mattress 10 hereinabove described is manufactured by first assembly of the spring core portion 12 of the mattress, including the upholstered side panels 25 and the top and bottom fabric covers 22, 46. An upholstered fabric flange 27 is then sewn or secured in a conventional manner to the top of the upholstered side panels 25 so as to extend around the complete periphery of the mattress. This flange 27 is topped by the lower half 26*b*, 28*b* of the closures 28. A lower flange 27*a* of the quilt panel 52 having the top 26*a*, 28*a* of the closures 26, 28 attached thereto is then attached to the flange 27 by closing of the zippers 26, 28. The bottom of the expandible divider or fold 20 is then secured to the bottom fabric cover 46 of the core support portion 12 of the mattress.

Several different methods may be used to manufacture the top quilt panels 52 with its expansible fold 20 before its attachment to the base support portion 12 of the mattress. One of the more practical methods is to manufacture an oversize quilt panel 52 on a conventional quilting machine, but to manufacture it initially several inches wider than the width of the core support portion 12 of the mattress. For example, if the fold is to be 4½ inches in depth, then the quilt panel 52 would initially be made 9 inches wider than the width of the core support portion 12 of the mattress. The oversize quilt panel 50 would then have 4½ inches of quilt panel resilient or padding materials (plies 62, 64, 66) removed from each side of the longitudinal center line of the quilt panel 52 to leave 9 inches of fabric material 60 available to make the expansible fold 20 which would then be attached at the bottom 68 of the fold to the top of fabric covering material 48 of the core support portion 12 of the mattress.

Another method of manufacturing the quilt panel 52 would be to manufacture it in two longitudinally extending halves or a conventional quilting machine, but with a center flange slightly more than 4½ inches in width on one side, the side on which the fold 20 was to be formed or created. After completion of the quilting operation on the quilting machine, the two quilted halves of the quilt panel 52 would then be sewn together to create a 9 inch section of fabric 60 extending between the two quilted halves of the quilt panel 52. This 9 inch center section of fabric could then be folded to create a 4½ inch depth expansible seam, the bottom 68 of which could then be attached at 70 to the top fabric covering ply 48 of the core support portion 12 of the mattress.

Figure 4:
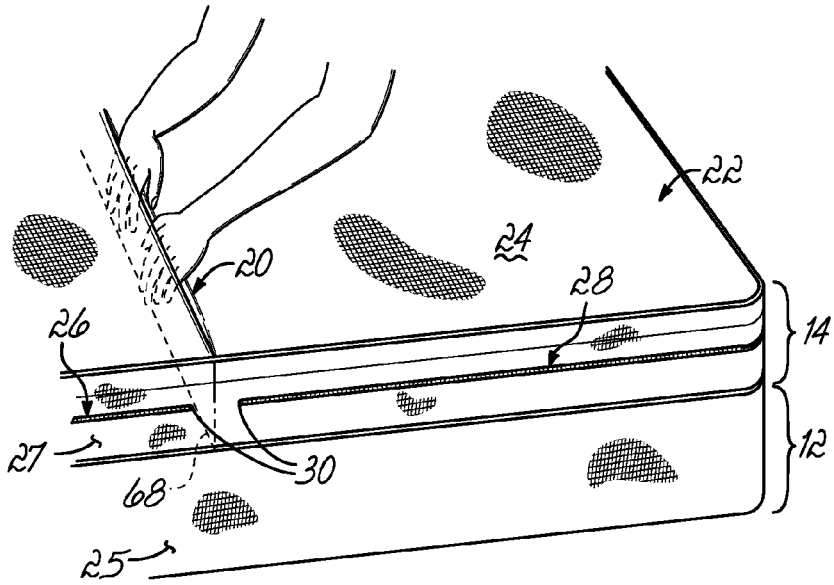
FIG. 4 is a perspective view of one portion of the mattress illustrating the expansible divider separating two sections of the upper topper portion of the mattress.

With reference now to FIGS. 3 and 4, it will be seen that when two people 72, 74 are resting atop the mattress on each half thereof with the expandible divider or fold 20 separating the two, movement of one person atop one half of the mattress will not affect or be imparted to the other half since that movement will be absorbed by movement of the fold on the moving person's half of the mattress without imparting any movement to the other half of the fold and, consequently, the fabric covering on the other half of the mattress.

While I have described and illustrated the expansible divider 20 as separating the mattress into two equal longitudinally extending halves suitable for supporting two individuals on each half, it will be appreciated that the expansible divider could as well be used to separate or isolate other sections of a mattress.

Persons skilled in this art will appreciate numerous other changes and modifications which may be made without departing from the spirit of this invention. For example, the comfort zone of the mattress could contain one or more plies of foam or fiber padding and, similarly, the quilted panel 52 could contain one or more plies of either fiber or foam or combinations thereof. Similarly, the mattress may be in the form of a conventional pillow top as opposed to a flat top mattress as illustrated in the drawings of this application. I therefore do not intend to be limited except by the scope of the following claims.

I claim:

1. A mattress comprising:

a lower core support member;

an upper topper portion resting atop said core support member;

an expandable divider separating said upper topper portion into two halves;

said expandable divider comprising a fold in at least a top fabric cover of said upper topper portion of said mattress such that movement atop one of said halves will be absorbed by said fold and not imparted to the other of said two halves; and wherein the bottom of said fold is fixedly secured to the top of said lower core support member.

2. The mattress of claim 1 wherein said expandable divider comprises a generally U-shaped fold in at least a top fabric cover of said upper topper portion of said mattress, said fold having a depth of at least two inches.

3. The mattress of claim 2 wherein said fold is approximately four and one half inches in depth.

4. The mattress of claim 1 which further comprises:

a closure mechanism coupled to said upper topper portion selectively providing access to an interior volume thereof; and at least one auxiliary support element removably disposed within said interior volume of said upper portion by way of said closure mechanism.

5. The mattress of claim 1 which further comprises:

a closure mechanism coupled to said fabric along a perimeter of said upper topper portion selectively providing access to an interior volume of a first lateral half and a second lateral half of said upper portion;

a first plurality of auxiliary support elements, at least one of which is removably disposed in said interior volume of said first lateral half of said upper portion; and a second plurality of auxiliary support elements, at least one of which is removably disposed in said interior volume of said second lateral half of said upper portion.

6. A mattress comprising:

a lower core support member;

an upper topper portion resting atop said core support member;

an expandable divider separating said upper topper portion into two halves;

a top surface of said upper topper portion comprising a fabric material, said expandable divider comprising a fold in the fabric material of said upper topper portion of said mattress; and wherein said lower core support member has a top surface, said fold having a bottom edge, said bottom edge of said fold being fixedly secured to the top surface of said core support member.

7. The mattress of claim 6 wherein said bottom edge of said fold is sewn or welded to the top surface of said core support member.

8. A split support configuration mattress comprising:

a fabric body;

a core support member disposed within said fabric body;

an upper topper portion between said core support member and a top portion of said fabric body;

an expandable divider separating said upper topper portion into a first lateral half and a second lateral half;

said expandable divider comprising a fold in said fabric body separating said lateral halves such that movement atop one of said halves will be absorbed by said fold and not imparted to the other of said two halves; and wherein the bottom of said fold is fixedly secured to a top surface of said lower core support member.

9. The mattress of claim 8 wherein said bottom of said fold is sewn or welded to the top surface of said core support member.

10. A split support configuration mattress comprising:

a fabric body;

a core support member disposed within said fabric body;

an upper topper portion between said core support member and a top portion of said fabric body;

an expandable divider separating said upper topper portion into a first lateral half and a second lateral half;

said core support member including a plurality of spring elements, an insulator pad covering said spring elements, and a top fabric material covering said insulator pad, said expansible divider comprising a fold in said fabric body separating said lateral halves a bottom of said fold being fixedly secured to said top fabric material of said core support member.

11. A split support configuration mattress comprising:

a fabric body;

a core support member disposed within said fabric body;

an upper topper portion between said core support member and a top portion of said fabric body;

an expandable divider separating said upper topper portion into a first lateral half and a second lateral half;

said core support member including at least one foam plastic support element and a top fabric material covering said foam plastic support element; and said expansible divider comprising a fold in said fabric body separating said lateral halves of said upper topper portion, a bottom of said fold being fixedly secured to said top fabric material of said core support member.

* * * * *